United States Patent [19]

Dreyer

[11] Patent Number: 4,612,551

[45] Date of Patent: Sep. 16, 1986

[54] ARRANGEMENT FOR THE OMNIDIRECTIONAL ORIENTATION OF AN ANTENNA

[75] Inventor: Claude Dreyer, Gelannes, France

[73] Assignee: S.I.C.A.R.T. (Societe Indusrielle de Construction d'Accessories Radio et Television, Nogent-sur-Seine, France

[21] Appl. No.: 563,078

[22] Filed: Dec. 19, 1983

[30] Foreign Application Priority Data

Dec. 20, 1982 [FR] France ..... 82 21308

[51] Int. Cl.[4] ..... H01Q 3/02

[52] U.S. Cl. ..... 343/765; 343/882

[58] Field of Search ..... 343/765, 766, 840, 880, 343/881, 882, 912

[56] References Cited

U.S. PATENT DOCUMENTS 3,146,452 8/1964 Rose ..... 343/758
3,510,877 5/1970 Turriere ..... 343/765
3,951,511 4/1976 Parsons .

FOREIGN PATENT DOCUMENTS 1956172 5/1971 Fed. Rep. of Germany .
2246945 4/1974 Fed. Rep. of Germany .
2234617 1/1975 France .

*Primary Examiner*—Eli Lieberman
*Attorney, Agent, or Firm*—Fleit, Jacobson, Cohn & Price

[57] ABSTRACT

The present invention relates to an arrangement for the omnidirectional orientation of an antenna. The arrangement includes a housing mounted on a fixed mast so that it can rotate around the axis of the latter, and an antenna support mounted on the housing so that it can rotate around an axis perpendicular to the mast. Two adjustment assemblies including a toothed ring integral with one of the elements of the adjustment assemblies and a worm engaged on the toothed ring and mounted immovable in translation on another element of each adjustment assembly, allow the antenna to be adjusted finely in elevation and in the azimuth. The arrangement also includes locking means for locking each of the adjustment assemblies. In the event of the deterioration of the adjustment arrangements associated with the fixing arrangement, the effectiveness of the immobilization is not prejudiced.

9 Claims, 8 Drawing Figures

Figure 2:
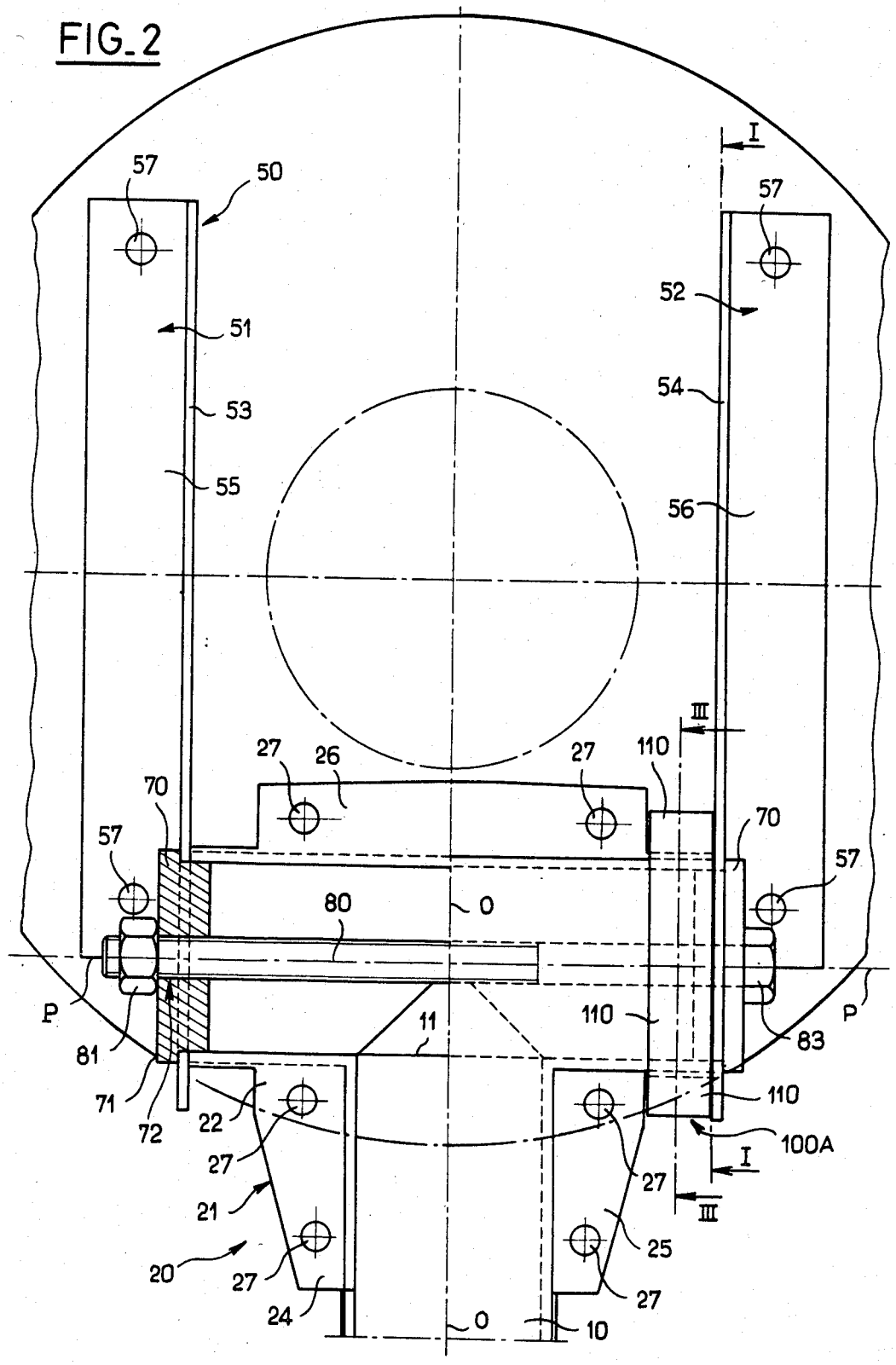

FIG_1
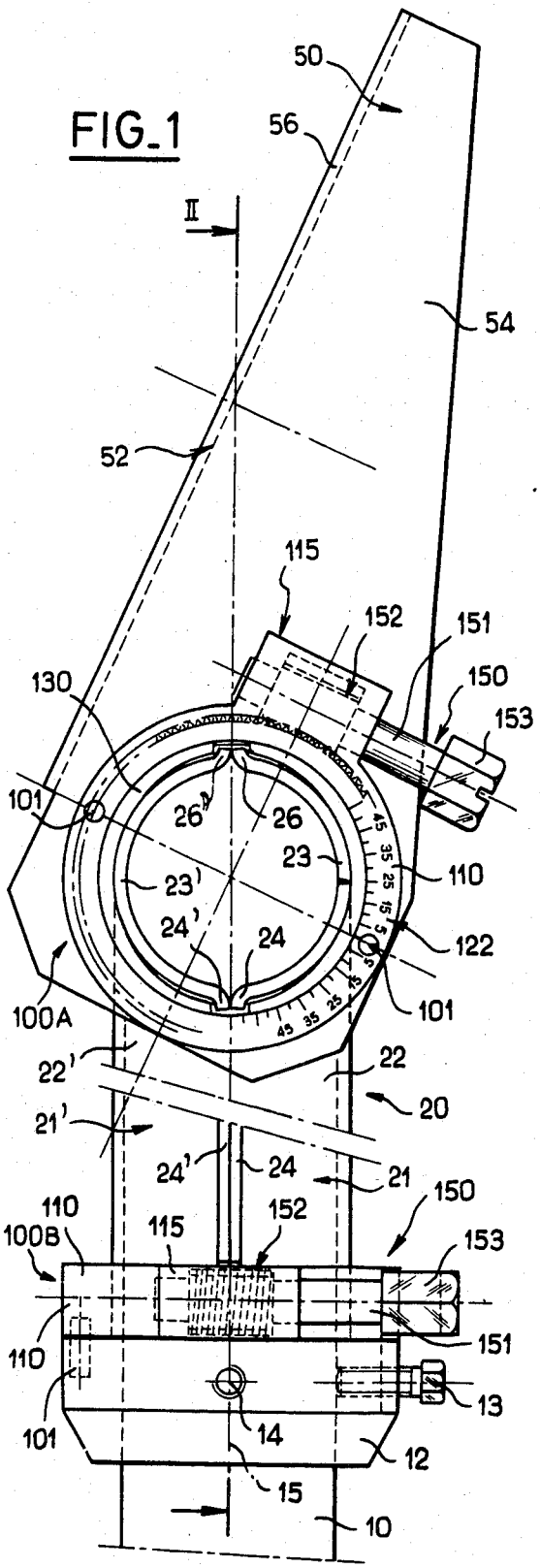
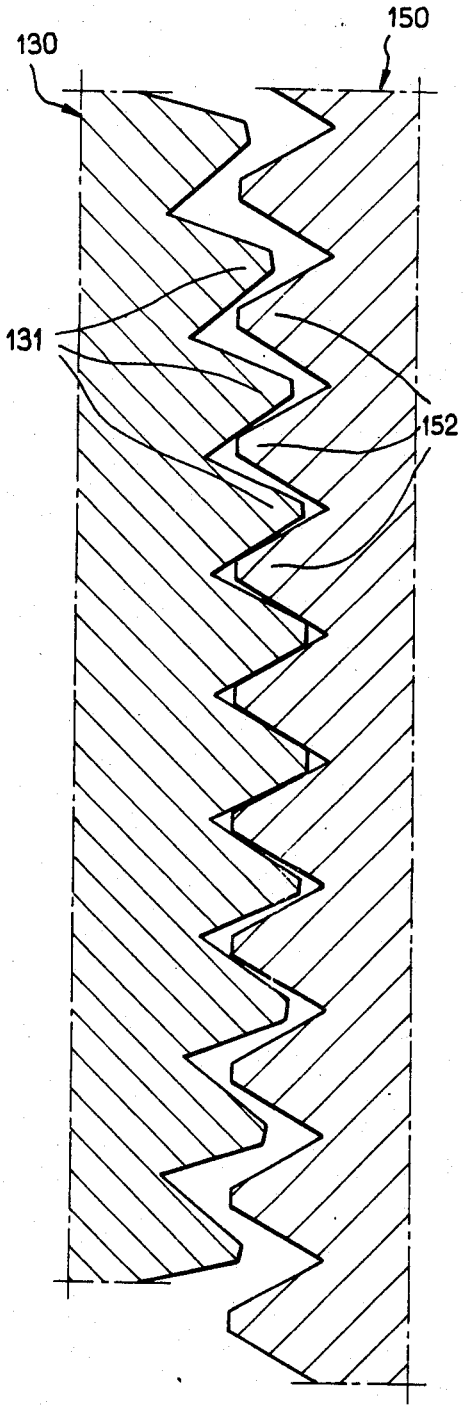
FIG_8

ARRANGEMENT FOR THE OMNIDIRECTIONAL ORIENTATION OF AN ANTENNA

The present invention relates to the field of antenna supports.

More precisely, the present invention relates to an arrangement for the omnidirectional orientation of antennae.

Various arrangements which allow adjustment of the orientation of an antenna have already been proposed. The most usual arrangements for the orientation of an antenna are composed of flanges and arcs which co-act to support the antennae. Such arrangements do not readily allow the antenna to be orientated omnidirectionally.

Arrangements which are more elaborate from the technical point of view have been proposed, but these are unsatisfactory, particularly with regard to cost, strength and precision.

One object of the present invention is to provide an orientation arrangement which allows the orientation of the antenna to be adjusted finely, in elevation and/or in the azimuth.

Another object of the present invention is to provide an arrangement for the orientation of an antenna which is simple to use and to install, and which is economical, so that it may be used in the field of application known as the "general public".

Another object of the present invention is to provide a particularly robust arrangement for the orientation of an antenna, so that the unit may be held precisely in the appropriate, chosen position in a reliable and lasting manner.

As will appear clearly from the description which follows, the arrangement for the omnidirectional orientation of antennae according to the present invention is especially suitable for supporting parabolic antennae where with the previously proposed arrangements any mounting operation was made arduous by the bulk of the antenna.

The arrangement according to the present invention for the omnidirectional orientation of an antenna comprises a housing formed of two arms perpendicular to each other and mounted in the vicinity of a first tubular arm on a fixed mast so that it can rotate around the axis thereof, an antenna support, mounted on the second arm of the housing so that it can rotate around the axis of this arm, together with two identical adjustment assemblies, one of which appertains to the mast/housing articulation, and the other appertaining to the housing-/support articulation, each adjustment assembly comprising a toothed ring integral with one of the elements of the said articulations, and a worm engaged on the said toothed ring and mounted immovably in translation on the other element of each articulation, so that by action on one of the worms the elements of the associated articulation are displaced relatively by rotation, thereby adjusting the elevation or the azimuth of the antenna, the arrangement also comprising locking means for locking each of the articulations in the adjusted position.

According to a preferred embodiment the housing is composed of two symmetrical half-shells, each having two wings disposed perpendicular to each other in the form of a T, each of the two wings having a substantially hemi-cylindrical envelope, and at least the first wing, which is joined on in the middle of the second at rightangles, being formed of a hemi-cylindrical wall, and each of the half-shells having flat flanges in the vicinity of their straight edges, projecting towards the outside and designed to rest against each other when the two half-shells are brought into contact with each other to form the housing.

More precisely, preferably the flat flanges provided projecting towards the outside on the wings of the half-shells are provided with holes designed to receive assembly bolts when the two half-shells are brought into contact against each other in the vicinity of their flat flanges.

According to one characteristic of the present invention the locking means for locking the housing/support articulation comprise a threaded component engaged in a through-bore provided in the vicinity of the second arm of the housing, the said threaded component being designed to be tightened on two radial abutment surfaces provided on either end of this second arm, respectively.

Preferably, with regard to the said adjustment assembly appertaining to the mast/housing articulation the toothed ring is integral with the housing and the worm is mounted on the support.

According to an advantageous embodiment, each adjustment assembly comprises a protective casing formed of two half-shells integral with one of the elements of each articulation, the said casing defining a housing suitable for holding the freely rotating toothed ring, as well as a chamber suitable for receiving the worm freely rotating but immovable in translation, in a position adjacent to the ring.

According to another characteristic of the present invention the toothed ring is provided with straight teeth over its external periphery and has at least one radial groove on its internal periphery into which the flat, connected flanges of the two half-shells of the housing are designed to penetrate in order to hold the toothed ring and the housing rotationally fixed.

According to another advantageous characteristic of the present invention each half-shell of the protective casing is composed of a planar surface in the form of a shoulder to which a cylindrical sleeve is connected, a hollow body communicating with the inside of the cylindrical sleeve to receive the worm when the half-shells of the protective casing are assembled, and connecting lugs.

Other characteristics and advantages of the present invention will become apparent from the detailed description which follows, with reference to the attached drawings, given by way of non-limiting example, and in which:

FIG. 1 shows a schematic sectional view of an articulation arrangement according to the present invention, sectioned along a plane designated I—I on FIG. 2, FIG. 2 shows the same arrangement with the left-hand half sectioned along a plane designated II—II on FIG. 1, and the right-hand half showing an external lateral view.

Figure 4:
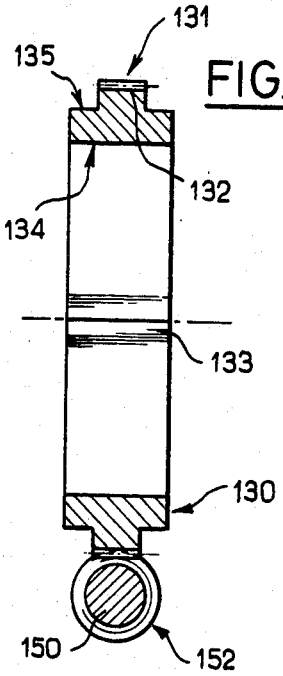
Figure 3:
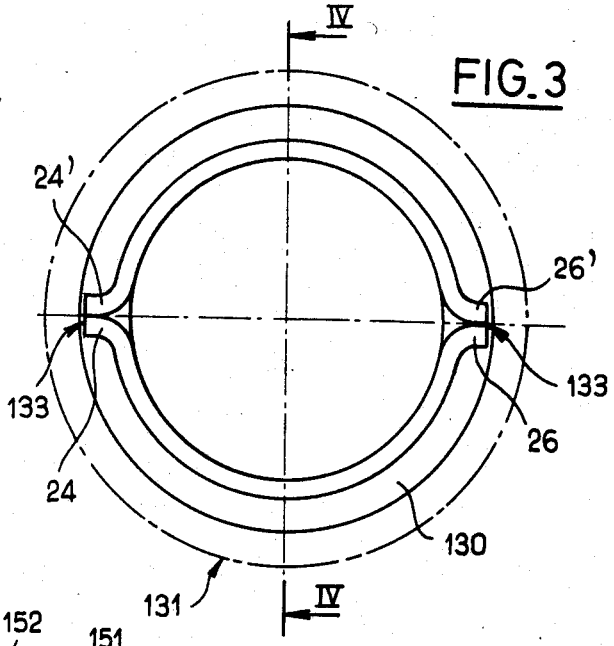
Figure 5:
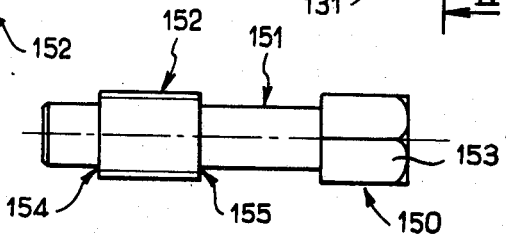
Figure 7:
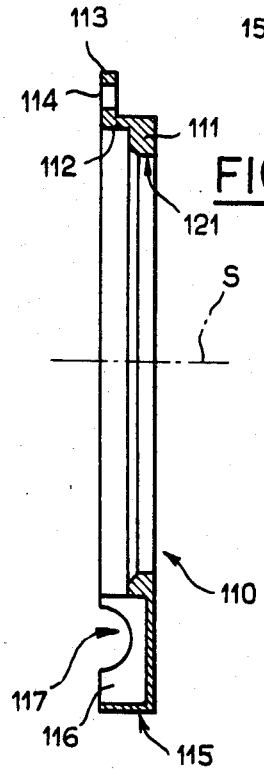
Figure 6:
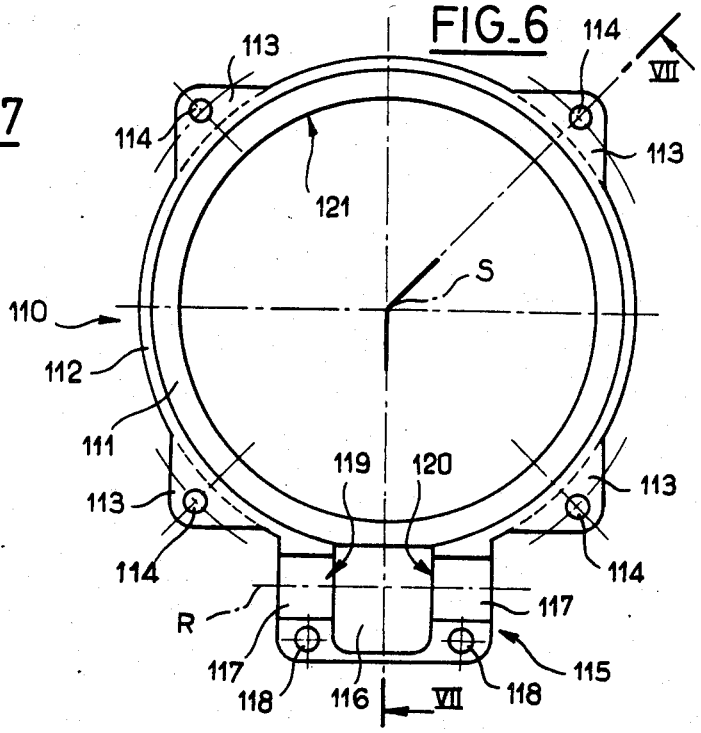

FIG. 3 is a partial view of an adjustment assembly according to the present invention, sectioned along a plane designated III—III in FIG. 2, FIG. 4 is a partial view of an adjustment assembly according to the present invention, sectioned along a plane designated IV—IV in FIG. 3, FIG. 5 is a lateral view of a worm used in an adjustment assembly according to the present invention, FIG. 6 is a partial lateral view of a half-shell of a protective casing used for an adjustment assembly according to the present invention, FIG. 7 is a view of this same half-shell sectioned along a plane designated VII—VII in FIG. 6, passing through two non-co-planar planes.

As is shown particularly in FIGS. 1 and 2, the omnidirectional orientation arrangement for an antenna (not shown on the Figures) according to the present invention comprises a housing 20 rotatably mounted on a fixed mast 10 which is preferably vertical, and which in turn supports rotatably an antenna support 50. Furthermore, two identical adjustment assemblies are associated respectively with the mast 10/housing 20 articulation and with the housing 20/support 50 articulation. The purpose of such adjustment assemblies is to set precisely the relative position of each of the elements of the aforementioned articulations.

The adjustment assemblies are given the general designation 100. More precisely, the adjustment assembly appertaining to the housing 20/support 50 articulation is given the designation 100A, while the adjustment assembly appertaining to the mast 10/housing 20 articulation is given the general designation 100B.

As shown on FIGS. 1 and 2, the housing 20 is composed of two half-shells 21, 21′ which are symmetrical and each have two wings 22, 23 and 22′, 23′ respectively, disposed perpendicular to each other and joined together in the shape of a T. Each of the two wings 22, 23, 22′, 23′ has a substantially hemi-cylindrical envelope. More precisely, according to the embodiment shown on the Figures, each of the two wings is formed by a hemi-cylindrical wall, the axes of which are designated O—O and P—P respectively on FIG. 2.

These two axes O—O and P—P are perpendicular to each other.

The two hemi-cylindrical walls forming the respective wings 22, 22′ and 23, 23′ preferably have the same radius of curvature. The wings 22 and 22′ of the half-shells 21, 21′ designed to form jointly a first arm of the housing 20 when the said half-shells are assembled together are joined to the middle of the wings 23, 23′.

Furthermore, as shown on FIGS. 1 and 2, each of the half-shells 21, 21′ has a flat flange in the vicinity of the straight edges of its walls; these flanges are designated 24, 25, 26 and 24′, 25′ and 26′ on the Figures, and extend projecting towards the outside of the said hemi-cylindrical envelopes. More precisely, the flat flanges 24, 25, 26 and 24′, 25′ and 26′ are arranged so that their external surface which is visible in the left-hand half of FIG. 2, is located in the common plane of the said axes O—O and P—P, that is to say, the plane defined by the said hemi-cylindrical envelope. Thus, when the two half-shells 21, 21′ are brought into contact with each other to form the housing 20, as shown in FIG. 1, the flat flanges 24, 25, 26 and 24′, 25′, 26′ provided respectively on each of the two half-shells come to rest against each other.

Each of the flat flanges 24, 25, 26 and 24′, 25′ and 26′ projecting outwardly is provided with holes designated 27 (shown on FIG. 2) which are designed to take assembly bolts (not shown) when the two half-shells 21, 21′ are brought into contact with each other in the vicinity of their flat flanges 24, 25, 26 and 24′, 25′, 26′.

If required, assembly of the two half-shells can be effected by welding.

Preferably, the upper end of the fixed mast is engaged in the housing 20 at least over the whole length of the first arm with the axis O—O, formed by the said wings 22 and 22′. The axis 15 of the mast 10 thus corresponds substantially with the respective axes O—O of the half-shells 21, 21′. Moreover, the radius of curvature of the hemi-cylindrical walls of the wings 21 and 21′ is substantially equal to or even slightly less than the radius of curvature of the cylindrical fixed mast 10 so that when the assembly bolts are engaged in the holes provided in the flat flanges 24, 25 connected to the first wing 22, 22′ of each half-shell 21, 21′, tightening of nuts engaged on the said bolts causes the two shells 21, 21′ forming the housing 20 to be drawn more tightly against the mast, so as to prevent any relative displacement between these two elements.

The upper radial end of the mast has been designated 11 on FIG. 2. In the embodiment shown on this Figure this surface 11 is tangential to the cylindrical wall of the wing 23, 23′, although naturally this wall may, if required, project slightly beyond this, inside the volume defined by the two wings 23, 23′.

Moreover, as shown on FIG. 1, a sleeve 12, substantially in the form of a cylindrical truncated cone with an internal bore, is engaged on the fixed mast 10 and is held immovable in an appropriate position on the said mast with the aid of fixing screws 13 engaging in tapped bores 14 provided in the sleeve 12 perpendicular to the axis of its internal bore and thus to the axis of the mast 10. Thus, the sleeve 12 is held immovably in position on the mast 10 when the aforementioned screws 13 are applied against the mast. The sleeve 12 has an upper surface in the form of a shoulder, forming an abutment surface for the adjustment assembly 100B appertaining to the mast/housing articulation.

The arrangement whereby the antenna support 50 is articulated on the housing 20 will now be described.

Naturally, the antenna support 50 may be any suitable shape and that shown on the Figures should not be regarded as limiting.

In the present case, the antenna support comprises two angle bars 51, 52 extending substantially parallel with each other, and immovable relative to each other, being separated by a distance corresponding to the length of the wings 23, 23′ of the shells 21, 21′.

Each of the angle bars 51, 52 has a wing or cheek 53, 54 extending perpendicular to the axis P—P of the wings 23, 23′. Second wings or cheeks 55, 56, perpendicular to the first ones, are provided with holes 57 for attaching the antenna or an intermediate support. More precisely, the said cheeks 53 and 54 are designed to rest against the radial end surfaces defined by the free edges of the wings 23, 23′. To be even more precise, each of the said cheeks 53 and 54 is provided with a hole, the radius of which corresponds to the internal radius of curvature of the wings 23, 23′. The hole provided in each of the cheeks 53, 54 is designed to receive an obturating plug 70 engaging in these holes and projecting into the inside of the chamber defined by the wings 23, 23′ when the latter are co-acting. In order to restrict the penetration of the obturating plug 70 inside this chamber, the said plug has an outer cylindrical section 71 with a greater radius than that of the hole provided in the cheeks 53, 54. Moreover, the obturating plug 70 itself is provided centrally with a through-bore.

As shown on FIG. 2, an obturating plug 70 may be provided at each end of the wings 23, 23′, or an obturating plug 70 with a thrust washer which is analogous with the said section 71, on the side of the adjustment assembly 100A. The through-bores 72 provided in the obturating plugs 70 and the axis of which, in the assembled state, corresponds with the axis P—P of the wings 23, 23', allow the passage of a rod 80 with a thread on it, to project beyond the outside of each of the obturating plugs 70.

It will be readily appreciated that by tightening the nuts 81 (and, if appropriate, a lock-nut) on the threaded rod 80 on the outside of each of the obturating plugs 70, the cheeks 53, 54 are clamped firmly against each obturating plug 70 and the associated end of the wings 23, 23'. Thus, the antenna support 50 and the housing 20 are fixed immovably relative to each other.

Naturally, as shown on FIG. 2, a bolt 80 may be provided, with its head 83 resting on one side against the outside of the obturating plug 70 or the thrust washer, and co-acting on the other side with a nut 80 engaged on the threaded rod on the outside of the second obturating plug 70.

The construction described above enables the antenna to be orientated both in the azimuth and in elevation.

It will be recalled that adjustment in the azimth consists of adjusting the angle of a given vertical emission plane, while adjustment in elevation consists in adjusting the angle which the elevation line, that is, a straight line joining, for example, the centre of the antenna to a distant point corresponding to the centre of the radiation pattern forms with the horizontal plane.

Adjustment in the azimuth may be effected by loosening the bolts engaged in the holes 27 and rotating the housing 20 around the axis O—O, relative to the fixed mast 10. When the azimuth adjustment has been effected in this way, it is necessary only to retighten the bolts to hold these two elements rigidly immovable relative to each other.

Similarly, the elevation adjustment may be effected by loosening the threaded rod 80 to allow the antenna support 50 to rotate around the axis P—P. When the adjustment has thus been effected, all that is required is for this threaded rod 80 to be retightened to hold the antenna support 50 rigidly immovable relative to the housing 20.

The adjustment assemblies 100A and 100B used in accordance with the present invention will now be described in more detail.

Each adjustment assembly comprises a protective casing formed of two half-shells similar to that shown in FIGS. 6 and 7. The said protective casing is joined to one of the elements of each articulation by any suitable means, such as by the pins 101 shown on FIG. 1, or threaded components, or again by any other functionally equivalent means.

Each half-shell 110 is composed of a substantially planar surface 111 in the form of a shoulder to which a coaxial cylindrical sleeve 112 is connected. The planar surface 111 is chamfered on the inside. When two half-shells 110 are assembled together so that the free annular edges of the respective sleeves 112 come to rest on each other the protective casing defines a chamber which is suitable for accommodating a freely rotatable toothed ring 130. The ring 130 will be described in more detail in the following.

Preferably, as shown on FIGS. 6 and 7, each of the cylindrical sleeves 112 has on its external periphery and in the vicinity of its free edge, opposite the planar surface 111, lugs 113 which are generally parallel with the planar surface 111 and are provided with through-bores 114. Here again, the latter are designed to receive any appropriate locking device such as threaded components, to connect the half-shells 110 rigidly.

In addition, each of the half-shells 110 is provided with a hollow body 115 communicating with the inside of the cylindrical sleeve 112 so as to define in the assembled state a chamber suitable for receiving a worm 150 co-acting with the ring 130. More precisely, the chamber is adapted to receive the worm 150 freely rotatable but immovable in translation in a position adjacent to the ring so that the threads provided on the periphery of the worm 150 mesh with gearing 130, such as straight teeth, provided on the external periphery of the toothed ring 130 accommodated in the said housing.

Preferably, as shown on FIG. 5, a worm 150 will be used which is composed of a smooth annular cylindrical body 151 with external threads 152 provided over approximately a third of its length. At one of its ends the worm has a head 153.

The section with the thread 152 has an external diameter which is greater than that of the rest of the smooth cylindrical shank 151. The aforementioned hollow bodies 115 provided on the half-shells 110 define a hemi-cylindrical chamber 116 designed to receive the thread 152 and also two hemi-cylindrical recesses 117 with a smaller radius on either side of the chamber 116 and co-axial therewith, to receive the smooth shank 151 of the worm 150. To do this, the axis R of the chamber 116 formed by the hollow body 115 connected on the outside of the cylindrical sleeve 112 extends perpendicularly to the axis S of the latter. Here again, the hollow body 115 is provided with holes 118, allowing two half-shells 110 to be made immovable relative to each other, to form the protective casing. It will be appreciated that the radial surfaces 119 and 120 on one hand and 154, 155 on the other hand, respectively provided on the half-shells 110 (which define the radial surfaces of the chamber 116) and on the worm 150 (which define the radial surface of the thread 152) enable the worm 150 to be held immovable in translation relative to the protective casing when the thread 152 is introduced into the chamber 116.

Furthermore, the protective casing being immovable relative to one of the elements of each articulation, it will be understood that any rotation of the worm 150 engaged with the toothed ring 130 entrains the latter in rotation round its own axis, and thus causes the two elements of each articulation to rotate relative to each other.

More precisely, with the embodiment shown in the Figures, with regard to the adjustment assembly 100A appertaining to the housing 20/support 50 articulation, the toothed ring 130 is rotationally fixed relative to the housing 20, and the worm 150 is fixed in translation relative to the support 50.

On the other hand, with regard to the said adjustment assembly 100B appertaining to the mast 10/housing 20 articulation, the toothed ring 130 is rotationally fixed relative to the housing 20 and the worm 150 is fixed in translation relative to the mast 10.

As shown on FIGS. 3 and 4, the teeth 131 provided on the toothed ring 130 are more precisely provided on the outside of an annular rib 132 on the external periphery of the ring 130, the width of this rib corresponding substantially to half the thickness of the ring 130.

Moreover, on its internal circumference 134 the ring 130 has two diametrally opposed radial grooves 133 into which a terminal section of the flat flanges 24, 24' to 26, 26′ on the said housing, which are of a suitable width, are designed to penetrate.

It will therefore be appreciated that the toothed ring 130 is engaged in translation on the housing 20 and is rotationally fixed thereon due to the said coaction between the grooves 133 and the free flanges of the housing.

Preferably, the width of the rib 132 corresponds to twice the height of the cylindrical sleeve 112 and the external radius of this rib 132 is at most equal to the internal radius of the sleeve 112, while the thickness of the ring 130 remaining on either side of the rib 132 in the vicinity of the surface designated 135 on FIG. 4 is equal to the thickness of the planar wall 111, and has a radius of curvature appreciably less than that of the internal cylindrical surface 121 of the ring 111.

A detail drawing of the teeth 152 formed on the worm 150 and the teeth 131 provided on the external surface of the ring 130, on an enlarged scale, is shown in FIG. 8.

In a particular embodiment, given by way of nonlimiting example, but which has given complete satisfaction in use, 120 teeth 131 may be provided on the periphery of the ring 130, each having an angle to the centre in the order of 3°.

The various steps of the installation of an arrangement according to the present invention will now be described.

In a first step, the sleeve 12 should be held immovably on the mast 10 in a predetermined position by means of the fixing screws 13.

The adjustment assembly 100B is then threaded on the mast 10 and comes to rest against the upper surface of the sleeve 12 by gravity. The adjustment assembly 100B (more precisely, the half-shells 110) is rotationally fixed relative to the sleeve 12 and the mast 10 by means of the above-mentioned pins 101. It is not necessary to fix the assembly 100B and the mast 10 in translation. The housing 20 equipped with the adjustment assembly 100A on one end of the wings 23, 23′ and bearing the antenna support 50 via the obturating plugs 70 and the threaded rod 80 is then threaded on the fixed mast 10. The housing 20 is rotationally fixed relative to the toothed wheel 130 housed in the protective casing of the adjustment assembly 100B by means of the flat flanges 24, 24′ and 25, 25′ engaged in the radial grooves 133.

In a similar way, the toothed ring 130 appertaining to the adjustment assembly 100A is rotationally fixed relative to the housing 20 by means of the complementary flat flanges engaged in the radial grooves 133 in the said toothed ring. This ring 130 is fixed in translation on the housing 20 by means of the threaded rod 80 and the plugs 70.

As already mentioned at the beginning, to ensure adjustment of the antenna in the azimuth the bolts engaged in the holes provided in the vicinity of the flat flanges 24, 24′ and 25, 25′ should be loosened, and the worm 150 appertaining to the adjustment assembly 100B is manipulated to cause the associated ring 130 to rotate. When adjustment in the azimuth has thus been effected by entraining the housing 20 in rotation around the vertical axis 15 of the mast, the said bolts are retightened.

In a similar way, the adjustment in elevation is carried out by loosening the threaded rod 80 and manipulating the worm 150 appertaining to the adjustment assembly 100A to entrain the antenna support 50 in rotation around the axis P—P of the housing 20. When adjustment in elevation has thus been effected the antenna support 50 is locked in position by means of the threaded rod 80. It will be readily appreciated that such an arrangement for the orientation of antennae is particularly suitable for effecting the adjustment of an antenna located in a valley when the relay transmitter is located on relatively higher ground.

Furthermore, such an arrangement is simple in construction and is therefore economical, as well as robust, reliable and easy to install. It should be noted that even in the event that the co-action between the toothed wheel 130 and the worm 150 should become defective, the arrangement can support the antenna perfectly and rigidly.

Specific dimensions of an orientation arrangement according to the present invention will now be given by way of non-limiting example:

diameter of the fixed mast: 50 mm
thickness of the walls of the half-shells 21, 21′ which form the housing 20:3.1 mm
internal diameter of the toothed ring 130:56.2 mm+0.1−0
external diameter of the toothed ring 130 level with the recess 135:64 mm+0−0.1
overall diameter or diameter at the extremity of the toothed ring 130 in the vicinity of the straight teeth 131:76 mm+0−0.1
diameter at the foot or diameter at the base of the teeth on the toothed ring 130:72.9 mm
overall diameter or diameter at the extremity of the worm 150 in the vicinity of the thread 152:13.4 mm, with a pitch of 200
diameter of the foot or the base of the teeth in the vicinity of the teeth 152 on the worm 150:11.54 mm
diameter of the smooth section 151 on the worm 150:10 mm+0−0.1
thickness of the toothed wheel 130:16 mm+0−0.1
width of the teeth 131:8 mm+0−0.1
width of the cylindrical sleeve 112:4 mm+0.1−0
thickness of the wall 111:4 mm+0.1−0
radius of curvature of the internal annular surface 121 of the half-shell 110:64.2 mm+0.1−0
radius of curvature of the cylindrical sleeve 112:76.2 mm+0.1−0
length of the threaded section 152:16 mm+0−0.2.

Preferably, the toothed ring 130 or the housing 20 is provided with a fixed mark and one of the half-shells 110 forming the protective casing is provided with a calibrated scale (FIG. 1) to facilitate precise adjustment.

Naturally, the present invention is not limited to the embodiment which has been described above, on the basis of which numerous variations could be envisaged, within the concept of the invention.

If required, the separate plugs 70 could be dispensed with and replaced by a structure which is integral with the cheeks 53, 54 of the angle bars; for example, such a structure might take the form of a cylindrical stamping with suitable dimensions for penetrating into the chamber defined by the wings 23, 23′ when joined together.

What is claimed is:

1. An arrangement for the omnidirectional orientation of an antenna supported by a fixed mast, said arrangement comprising:

(a) a generally "T" shaped housing having a first arm and a second arm extending perpendicular to each other, said housing including two symmetrical half-shells, each half-shell having two wings, said two wings being in the form of hemi-cylindrical walls disposed perpendicular to each other, a first wing being joined in the middle of the second wing at a right angle in the form of a "T", and each of the half-shells having flat flanges in the vicinity of their straight edges, projecting outwards and resting against each other when the two half-shells are brought into contact with each other so that two first wings form said first arm of the housing and two second wings form a said second arm of the housing, said first arm being mounted on the fixed mast so that said first arm and the fixed mast compose two elements of a first articulation located around a first axis, (b) an antenna support mounted on said second arm so that said second arm and said antenna support compose two elements of a second articulation located around a second axis which is perpendicular to said first axis, (c) two identical adjustment assemblies, a first adjustment assembly which is associated with said first articulation and a second adjustment assembly which is associated with the said second articulation, each adjustment assembly including a toothed ring integral with one of the elements of said articulations, and a worm engaged on said toothed ring and mounted immovably in translation on the other element of each articulation so that by action on one of the worms, the elements of the associated articulation are displaced relatively by rotation, thereby adjusting one of the elevation and the azimuth of the antenna, and (d) first locking means and second locking means for locking each of the articulations in the adjusted position.

2. An arrangement according to claim 1, wherein said flanges are provided with holes which, when said half shells are brought into contact with each other to form said housing, can receive assembly bolts which extend through both said half shells.

3. An arrangement according to claim 2, including assembly bolts which pass through said holes and which constitute at least part of said first locking means.

4. An arrangement according to claim 1, wherein said second locking means comprises a threaded rod which passes along said second arm and which is operatively connected to said antenna support so that when said threaded rod is tightened said antenna support is locked relative to said housing.

5. An arrangement according to claim 1, wherein said toothed ring of the second adjustment assembly is secured to the second arm of said housing, and said worm of the second adjustment assembly is secured to said antenna support.

6. An arrangement according to claim 1, wherein said toothed ring of the first adjustment assembly is secured to the first arm of said housing, and said worm of the first adjustment assembly is secured to said fixed mast.

7. An arrangement according to claim 1, wherein said first and second adjustment assembly each comprises a protective casing formed of two half-shells fast with one of the elements of the articulation, said protective casing defining a housing holding the toothed ring and a chamber retaining the worm so that it is free to rotate therein but is substantially immovable in translation relative thereto.

8. An arrangement according to claim 7, wherein each half-shell of the protective casing comprises a planar surface in the form of a shoulder to which a cylindrical sleeve is connected, a hollow body communicating with the inside of the cylindrical sleeve to receive the worm when the half-shells of the protective casing are assembled together, and connecting lugs.

9. An arrangement according to claim 1, wherein said toothed ring is provided on its internal periphery with at least one slot which accommodates at least one of said flanges and thereby secures said toothed ring against rotation relative to said housing.

* * * * *

UNITED STATES PATENT AND TRADEMARK OFFICE

CERTIFICATE OF CORRECTION

PATENT NO. : 4,612,551

DATED : September 16, 1986

INVENTOR(S) : Claude DREYER

It is certified that error appears in the above-identified patent and that said Letters Patent is hereby corrected as shown below:

Please correct the name of Assignee [73] to read:

S.I.C.A.R.T. (Société Industrielle de Construction d'Accessoires Radio et Télévision),

Signed and Sealed this

Seventeenth Day of March, 1987

*Attest:*

DONALD J. QUIGG

*Attesting Officer*

*Commissioner of Patents and Trademarks*